US011440209B2

(12) United States Patent
Hou et al.

(10) Patent No.: US 11,440,209 B2
(45) Date of Patent: Sep. 13, 2022

(54) CONICAL SELF-POSITIONING LIMIT FEEDING DEVICE AND METHOD

(71) Applicants: QINGDAO UNIVERSITY OF TECHNOLOGY, Shandong (CN); INNER MONGOLIA UNIVERSITY FOR NATIONALITIES, Inner Mongolia (CN)

(72) Inventors: Yali Hou, Qingdao (CN); Changhe Li, Qingdao (CN); Dongzhou Jia, Qingdao (CN); Huayang Zhao, Qingdao (CN); Wenyue Liu, Qingdao (CN); Dan Liu, Qingdao (CN); Yuhui Zhao, Qingdao (CN); Zhongqi Lu, Qingdao (CN); Yucheng Wang, Qingdao (CN); Yanbin Zhang, Qingdao (CN); Min Yang, Qingdao (CN)

(73) Assignees: QINGDAO UNIVERSITY OF TECHNOLOGY, Qingdao (CN); INNER MONGOLIA UNIVERSITY FOR NATIONALITIES, Tongliao (CN)

( * ) Notice: Subject to any disclaimer, the term of this patent is extended or adjusted under 35 U.S.C. 154(b) by 175 days.

(21) Appl. No.: 16/960,821

(22) PCT Filed: Oct. 30, 2019

(86) PCT No.: PCT/CN2019/114456
§ 371 (c)(1),
(2) Date: Jul. 8, 2020

(87) PCT Pub. No.: WO2020/238006
PCT Pub. Date: Dec. 3, 2020

(65) Prior Publication Data

US 2021/0402638 A1 Dec. 30, 2021

(30) Foreign Application Priority Data

May 28, 2019 (CN) ..... 201910452459.8

(51) Int. Cl.
*B26D 7/06* (2006.01)

(52) U.S. Cl.
CPC ..... *B26D 7/0641* (2013.01); *B26D 2210/02* (2013.01)

(58) Field of Classification Search
CPC ..... B26D 7/0641; B26D 2210/02
See application file for complete search history.

(56) References Cited

U.S. PATENT DOCUMENTS 4,228,730 A * 10/1980 Schindler ..... A47J 37/1214 99/341
4,523,505 A * 6/1985 Polson ..... B26D 7/0641 83/872

(Continued)

FOREIGN PATENT DOCUMENTS

CN 102699941 A 10/2012
CN 106914933 A 7/2017

(Continued)

OTHER PUBLICATIONS

Feb. 21, 2020 International Search Report issued in International Patent Application No. PCT/CN2019/114456.

(Continued)

*Primary Examiner* — Sean M Michalski
(74) *Attorney, Agent, or Firm* — Oliff PLC

(57) ABSTRACT

A conical self-positioning limit feeding device and method. The conical self-positioning limit feeding device has bearing pot, empty circle in the center of bearing pot, U-shaped slide way formed between outer circle and inner circle, rotating evacuation cone and limit feeding rod arranged in the bearing pot and rotate in the same direction, and the speed (Continued)

of the rotating evacuation cone is greater than that of the limit feeding rod; materials are placed in the bearing pot, the evacuation cone rotates, and the materials rotate in the U-shaped slide way of the bearing pot by the torque generated by the friction between rotating evacuation cone and materials, till the long axes of the materials are tangent to the radius of the rotating evacuation cone; the limit feeding rod rotates and pushes materials to exit at equal intervals, thereby achieving the arrangement of the materials in the direction of long axis.

10 Claims, 2 Drawing Sheets

(56) References Cited

U.S. PATENT DOCUMENTS 4,621,573 A * 11/1986 Lange ..... A23N 12/023 15/3.16
4,911,045 A * 3/1990 Mendenhall ..... B26D 3/24 83/402
5,421,226 A * 6/1995 Mendenhall ..... B26D 7/22 83/402
5,765,472 A * 6/1998 Kim ..... B26D 3/283 83/167
5,960,709 A * 10/1999 Yip ..... B26D 3/22 241/199.12
8,459,245 B1 * 6/2013 Fiorill ..... F41B 11/53 366/279
2003/0051590 A1 * 3/2003 Kaplan ..... B26D 7/1818 83/167
2004/0040427 A1 * 3/2004 Mendenhall ..... A23L 19/18 83/402
2005/0092194 A1 * 5/2005 Bajema ..... B26D 9/00 99/537
2008/0277423 A1 * 11/2008 Garton ..... B29C 41/06 222/561
2009/0025519 A1 * 1/2009 Nanney ..... B26F 1/40 83/78
2012/0119408 A1 * 5/2012 Schmidt ..... A23G 3/0027 264/176.1
2014/0047964 A1 * 2/2014 Zhao ..... B26D 3/28 83/167
2014/0306040 A1 * 10/2014 Belotserkovskiy ..... B02C 25/00 241/207
2017/0120470 A1 * 5/2017 Young ..... F16L 41/02
2019/0261671 A1 * 8/2019 Vardakostas ..... A23P 20/20
2019/0289818 A1 * 9/2019 Smith ..... A01K 5/0225
2020/0205461 A1 * 7/2020 Cohen ..... A23P 20/20
2021/0039036 A1 * 2/2021 Okano ..... B01J 20/22
2021/0259206 A1 * 8/2021 Varnedoe ..... A01K 5/0225
2022/0036683 A1 * 2/2022 Umeda ..... G07D 3/14
2022/0097131 A1 * 3/2022 Matys ..... H05H 1/30

FOREIGN PATENT DOCUMENTS

CN 107613943 A 1/2018
CN 108501072 A 9/2018
CN 207844532 U 9/2018
CN 108858343 A 11/2018
CN 110103278 A 8/2019
WO 2012/120493 A2 9/2012
WO 2016/066367 A1 5/2016

OTHER PUBLICATIONS

Feb. 21, 2020 Written Opinion issued in International Patent Application No. PCT/CN2019/114456.

* cited by examiner

CONICAL SELF-POSITIONING LIMIT FEEDING DEVICE AND METHOD

FIELD OF THE INVENTION

The present disclosure relates to the technical field of machinery commonly used in industry and agriculture, in particular to a conical self-positioning limit feeding device and method.

BACKGROUND OF THE INVENTION

Potatoes are vegetatively propagated tuber crop. When planted, seed potatoes need to be diced. During dicing, in order to facilitate the identification of potato buds, the seed potatoes are cut in half. The data shows that it is preferred to cut in half throughout the centerline between the top bud and the bottom bud, that is, along the long axis.

The inventors found in research that most of the existing related technologies can realize compact arrangement conveying, but cannot realize equal interval conveying, and cannot adjust the interval between materials.

In addition, potatoes cannot be adjusted in the direction of long axis, which means that the long axes of potatoes cannot be on the same line.

Therefore, how to feed and adjust similar elliptical or cylindrical objects arranged in the direction of long axis in industry and agriculture is a technical problem to be solved by the present disclosure.

SUMMARY OF THE INVENTION

The purpose of the embodiments of this Description is to provide a conical self-positioning limit feeding device, which adjusts the directions of similar elliptical or cylindrical objects arranged in the direction of long axis to realize the arrangement in the direction of long axis.

An embodiment of this Description provides a conical self-positioning limit feeding device, which is implemented by the following technical solution:

The conical self-positioning limit feeding device comprises:

a bearing pot, an empty circle is reserved in the center of the bearing pot, a U-shaped slide way I-11 is formed between the outer circle and the inner circle, a rotating evacuation cone and a limit feeding rod are arranged in the bearing pot and rotate in the same direction, and the speed of the rotating evacuation cone is greater than that of the limit feeding rod; wherein materials are placed in the bearing pot, the rotating evacuation cone rotates, and the materials rotate in the U-shaped slide way I-11 of the bearing pot by the torque generated by the friction between the rotating evacuation cone and the materials, till the long axes of the materials are tangent to the radius of the rotating evacuation cone; and the limit feeding rod rotates and pushes the materials to an exit at equal intervals, thereby achieving the arrangement of the materials in the direction of long axis.

An embodiment of this Description provides a control method of the conical self-positioning limit feeding device, which is implemented by the following technical solution:

The control method comprises:

placing materials in the bearing pot, and controlling the rotating evacuation cone and the limit feeding rod to rotate in the same direction, wherein the speed of the rotating evacuation cone is greater than that of the limit feeding rod;

rotating the rotating evacuation cone, so that the materials rotate in the U-shaped slide way I-11 of the bearing pot by the torque generated by the friction between the rotating evacuation cone and the materials, till the long axes of the materials are tangent to the radius of the rotating evacuation cone; and rotating the limit feeding rod to push the materials to the exit at equal intervals, thereby achieving the arrangement of the materials in the direction of long axis.

Compared with the prior art, the beneficial effects of the present disclosure are:

The present disclosure facilitates cutting of objects (for example, seed potatoes) in the direction of long axis and direction adjustment of the potatoes to achieve the limitation in the direction of long axis.

The device disclosed by the present disclosure can solve the problem of direction adjustment of similar ellipses and cylinders, and limit direction adjustment again at desired positions, thereby realizing the arrangement function. The labor efficiency is effectively solved, and full mechanization is achieved.

BRIEF DESCRIPTION OF THE DRAWINGS

The accompanying drawings constituting a part of the present disclosure are used for providing a further understanding of the present disclosure, and the schematic embodiments of the present disclosure and the descriptions thereof are used for interpreting the present disclosure, rather than constituting improper limitations to the present disclosure.

Figure 1:
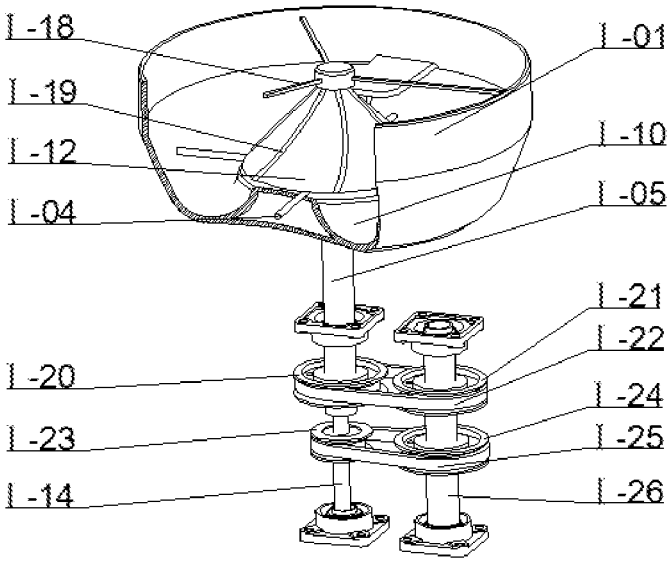
FIG. 1 is a cross-sectional view of an entire conical self-positioning limit feeding device according to an embodiment of the present disclosure.
Figure 2:
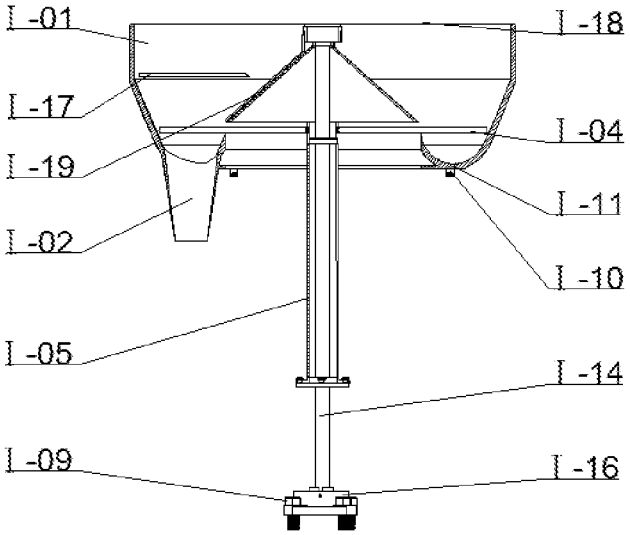
FIG. 2 is a cross-sectional view of the conical self-positioning limit feeding device except a drive according to an embodiment of the disclosure.

In the figures: I-01 bearing pot, I-02 leak hole, I-03 first support bearing, I-04 limit feeding rod, I-05 hollow shaft, I-06 first fixing bolt, I-07 second support bearing, I-08 second fixing bolt, I-09 third fixing bolt, I-10 fourth fixing bolt, I-11 U-shaped slide way, I-12 rotating evacuation cone, I-13 evacuation cone support frame, I-14 center shaft, I-15 third support bearing, I-16 fourth support bearing, I-17 shield, I-18 support frame, I-19 evacuation blade, I-20 first pulley, I-21 second pulley, I-22 first V-belt, I-23 third pulley, I-24 fourth pulley, I-25 second V-belt, I-26 indirect drive shaft.

DETAILED DESCRIPTION OF THE EMBODIMENTS

It should be noted that the following detailed descriptions are exemplary and are intended to provide further descriptions of the present disclosure. All technical and scientific terms used herein have the same meaning as commonly understood by those of ordinary skill in the technical filed to which the present application belongs, unless otherwise indicated.

It should be noted that the terms used herein are merely used for describing specific embodiments, but are not intended to limit the exemplary embodiments of the present invention. As used herein, the singular form is also intended to include the plural form unless otherwise indicated in the context. In addition, it should be understood that when the terms "includes" and/or "comprise" are used in the description, they are intended to indicate the presence of features, steps, operations, devices, components and/or combinations thereof.

Embodiment 1

This embodiment discloses a conical self-positioning limit feeding device, which can be used to arrange similar elliptical objects in the direction of long axis in industry and agriculture, and used to arrange similar cylinders in the direction of shaft diameter in industry and agriculture. The embodiment of the present disclosure will be described only using potatoes as an example, but the device is not only applicable to potatoes.

It is explained here that the long axis and short axis are the same as the long axis and short axis of an ellipse, which uses the characteristic that the shape of potatoes is similar to the ellipse. A potato reaches a desired state that the entire potato is almost located in a U-shaped slide way I-11, and its long axis is tangent to the radius of the center circle of the U-shaped slide way I-11.

As shown in FIGS. 1, 2, 3 and 4, the present disclosure discloses a conical self-positioning limit feeding device, which mainly comprises a rotating evacuation cone I-12, evacuation blades I-19, a limit feeding rod I-04, a bearing pot I-01, a leak hole I-02, and a shield I-17. The rotating evacuation cone I-12 is above an empty circle of the bearing pot I-01, the bearing pot I-01 is a main body of the whole device and is located at the bottom beyond a drive device (pulleys, V-belts, a center shaft, a hollow shaft), and the bottom of the bearing pot is under the rotating evacuation cone and the limit feeding rod, wherein the height of the rotating evacuation cone is lower than the height of the bearing pot, and the rotating evacuation cone and the limit feeding rod are both inside the bearing pot.

The empty circle is reserved in the middle of the bearing pot I-01, that is, the empty circle is a circular hole reserved in the middle of the bearing pot. The U-shaped slide way I-11 is outside the circle, a baffle is outside the U-shaped slide way I-11, and a leak hole I-02 and a shield I-17 are inside the bearing pot I-01. Evacuation blades I-19 are outside the rotating evacuation cone I-12, and the limit feeding rod I-04 is under the rotating evacuation cone I-12 and above the U-shaped slide way I-11.

In this embodiment, the slide way is similar to a channel, which facilitates the placement of potatoes. The slide way and the baffle constitute a bearing pot, which is used to load potatoes. The slide way is made like a channel to fix the potatoes.

The function of the evacuation blades is to block the potatoes that have not reached the desired state to arrive at the U-shaped slide way.

The rotating evacuation cone I-12 rotates to evacuate the potatoes all around due to the centrifugal force, and plays a main role in pushing the potatoes to achieve the direction adjustment function of the potatoes.

Figure 3:
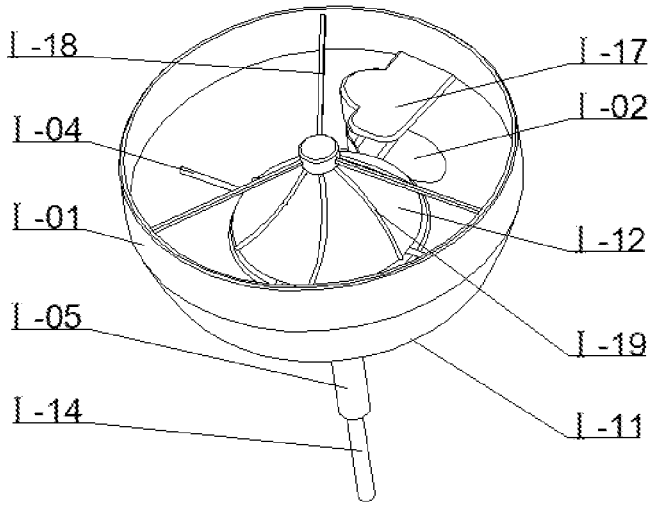
FIG. 3 is an axonometric view of the conical self-positioning limit feeding device according to an embodiment of the present disclosure.
Figure 4:
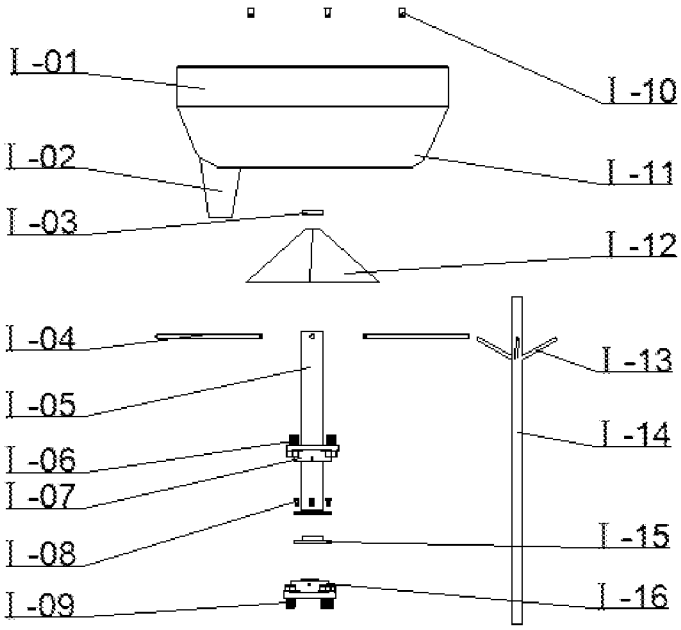
FIG. 4 is an exploded view except the drive device according to an embodiment of the present disclosure.

The shape of the rotating evacuation cone I-12 is similar to a cone, and is a normal cone; referring to FIG. 3, its slope near the bottom is gentler, so as to provide friction and to position potatoes; its movement form is counterclockwise rotation about a center shaft I-14 in a top-view direction, and the entire structure is empty inside and has only a few evacuation cone support frames I-13 welded to the center shaft I-14.

The evacuation cone support frames I-13 are connected with the center shaft I-14 inside the rotating evacuation cone I-12, and the rotation of the center shaft I-14 provides torque for the rotating evacuation cone I-12. The immobile evacuation blades I-19 are attached to the surface of the rotating evacuation cone I-12, but the evacuation blades I-19 are not directly connected to the rotating evacuation cone I-12, and there is a small gap between the evacuation blades I-19 and the rotating evacuation cone I-12.

The bottom of the rotating evacuation cone I-12 matches the empty circle in the middle of the bearing pot I-01; and the top of the rotating evacuation cone I-12 has a support frame I-18, the support frame I-18 is welded to the bearing pot I-01, and the support frame I-18 is directly welded to the evacuation blades I-19. The support frame is connected to the bearing pot to fix the evacuation blades.

The evacuation blades are above the rotating evacuation cone, and are fixed by welded with the immobile support frame I-18.

As the rotating evacuation cone is rotatable, the evacuation blades are immobile, then there is a small gap between the rotating evacuation cone and the evacuation blades, otherwise, the evacuation blades will rotate with the evacuation cone, and the purpose of present disclosure cannot be achieved.

The circle at the bottom of the rotating evacuation cone is placed on the empty circle in the middle of the bearing pot, but there must be a gap, because the limit feeding rod is to be placed under the rotating evacuation cone.

Referring again to FIG. 1, the center shaft I-14 and the hollow shaft I-05 provide torque for the rotating evacuation cone I-12 and the limit feeding rod I-04, respectively.

Specifically, the center shaft I-14 is connected to an indirect drive shaft I-26 by means of the belt drive of a third pulley I-23, a fourth pulley I-24, and a second V-belt, and the indirect drive shaft I-26 is connected to a motor. The drive of the center shaft is realized by means of the V-belt drive.

The hollow shaft I-05 is connected to the indirect drive shaft I-26 by means of the belt drive of a first pulley I-20, a second pulley I-21, and a first V-belt I-22 to realize the drive of the hollow shaft.

The center shaft I-14 is connected to the hollow shaft I-05 by a pair of third support bearings I-15, and the third support bearings I-15 are axially fixed by second fixing bolts I-08.

The center shaft I-14 is positioned by a first support bearing I-03 and a fourth support bearing I-16, a second support bearing I-07 is fixed by first fixing bolts I-06, the fourth support bearing I-16 is fixed by third fixing bolts I-09 and nuts, and the support frame I-18 is outside the first support bearing I-03 at the middle upper end of the center shaft I-14.

The center shaft I-14 at the lower end of the hollow shaft I-05 and the indirect drive shaft I-26 on the motor are driven by the second V-belt I-25, to realize the rotation of the center shaft I-14. The center shaft I-14 is connected to the third pulley I-23, the third pulley I-23 is fixed to the center shaft I-14 circumferentially by key connection, and the end face of the shaft is drilled for tapping to fix the third pulley I-23 axially with a nut. The first pulley I-20, the second pulley I-21, and the fourth pulley I-24 are fixed circumferentially and axially in the same manner.

The hollow shaft I-05 is connected to the first pulley I-20, and is also driven together with the indirect drive shaft I-26 by the first V-belt I-22, to realize the rotation of the hollow shaft I-05.

The second pulley I-21 and the fourth pulley I-24 on the indirect drive shaft I-26 are the smallest and have the same size, the first pulley I-20 on the hollow shaft I-05 is the largest, and the third pulley I-23 on the center shaft I-14 is medium; and the drive ratio of the first V-belt I-22 on the hollow shaft I-05 is larger than that of the second V-belt I-25 on the center shaft I-14.

The evacuation blades I-19 realize the limiting function for the potatoes that have not reached the desired state in the U-shaped slide way I-11 and the potatoes on the evacuation cone device, to block such potatoes from approaching the exit and reaching next device.

The evacuation blades I-19 are arc-shaped, converged at the top of the rotating evacuation cone I-12 along the bus of the rotating evacuation cone I-12, and welded to the support frame I-18 above the rotating evacuation cone I-12.

The support frame I-18 is at the top end of the center shaft I-14 and is connected to the center shaft I-14 through the first support bearing I-03, and the support frame I-18 is connected to the bearing pot I-01. The evacuation blades I-19 are fixed using the characteristic of immobility of the bearing pot I-01, and the rigidity of the center shaft I-14 is enhanced by the first support bearing I-03. The bottom end of the center shaft is connected to a frame plate through the fourth support bearing I-16, the third fixing bolts I-09 and nuts, so that the positioning of the entire center shaft is realized.

The limit feeding rod I-04 is under the evacuation blades I-19, the bottom of the evacuation blades I-19 is higher than the limit feeding rod I-04 to avoid the interference of the evacuation blades I-19 to the limit feeding rod I-04, and the bottom of the evacuation blades I-19 is also not connected to the rotating evacuation cone I-12.

The limit feeding rod I-04 blocks subsequent potatoes from squeezing and pushing the previous potatoes irregularly while the potatoes are slowly conveyed in the U-shaped slide way I-11, thereby realizing equal interval conveying of the potatoes.

Two circles can be seen when the bearing pot is looked down, one is the empty circle in the middle, and the other is an outline circle of the bearing pot. The U-shaped slide way is between the empty circle and the outline circle.

The limit feeding rod I-04 rotates in the same direction as the rotating evacuation cone I-12 but at a different speed, the speed of the limit feeding rod I-04 is lower than that of the rotating evacuation cone I-12, and the limit feeding rod I-04 is welded to the hollow shaft I-05.

The limit feeding rod I-04 is above the U-shaped slide way I-11 in the bearing pot I-01, one end of the limit feeding rod I-04 is at the bottom of the rotating evacuation cone I-12 and is welded to the hollow shaft I-05 therein, the other end of the limit feeding rod I-04 is on the inner wall of the bearing pot I-01 with a gap but no connection, and the limit feeding rod I-04 and the radius of the rotating evacuation cone I-12 are on the same straight line.

The bearing pot I-01 realizes the function of loading potatoes, provides a movement place, and limits the range of movement.

The shape of the bearing pot I-01 is similar to a hemisphere with a circle in the middle is removed, and the outer height is greater than twice the size of the short axis, which facilitates stable loading of potatoes. The bearing pot I-01 is fixed to the frame through fourth fixing bolts I-10 and nuts.

The empty circle is in the middle of the bearing pot I-01, and has a size matching with the size of the bottom surface of the rotating evacuation cone I-12, which facilitates the engagement with the rotating evacuation cone I-12.

The U-shaped slide way I-11 composed of two concentric circles is outside the empty circle, and the width of the U-shaped slide way I-11 approximates the length of the short axis of the potato, which facilitates the positioning of the potato in the short-axis direction.

A leak hole I-02 is formed at the U-shaped slide way I-11 of the bearing pot I-01, and potatoes arrive at next device through the leak hole I-02. The leak hole I-02 has a size of the largest potatoes, so that all potatoes reach the next device smoothly.

The "arrow"-shaped shield I-17 is riveted above the leak hole I-02.

The shield I-17 is located directly above the leak hole I-02, and is mainly to prevent potatoes from rolling over, and at the same time to block the potatoes on the other side that have not reached the desired state and just poured into the device above the leak hole I-02 from entering next device accidentally.

The shield I-17 is similar to an arrow, which facilitates the observation of movement of the potatoes. The shield I-17 is made as a transparent device, and has a size close to the leak hole I-02.

The shield I-17 covers the entire leak hole I-02, and a space for entering next device is reserved only on one side of the shield I-17. Since the height of shield I-17 is higher than a cross rod, the cross rod can pass through the shield I-17 smoothly, without being blocked by the shield I-17. The shield I-17 is divided into two parts, the upper part and the lower part are welded to the bearing pot I-01 respectively, leaving a gap of the cross bar in the middle.

The limit feeding rod of the present disclosure crosses the U-shaped slide way I-11 outside the inner circle of the bearing pot, a bearing outer bearing seat at the top end of the center shaft is connected to the evacuation blades, the evacuation blades are attached to the outer surface of the rotating evacuation cone, the bearing seat is welded to the bearing pot by a bracket, and the limit feeding rod is connected to the hollow shaft by the bracket. Crossing the U-shaped slide way I-11, that is, the swinging direction of the rod, is perpendicular to the tangential direction of the top-view circle of the U-shaped slide way, equivalently consistent with the radius of the circle. The limit feeding rod is also inside the bearing pot and between the rotating evacuation cone and the U-shaped slide way, and the limit feeding rod rotates about the hollow shaft and is on the same straight line as the radius of the bearing pot.

The rotation centers of the rotating evacuation cone and the limit feeding rod are the same. In order to achieve different rotation speeds at the concentric place, a pair of bearings is connected to the outside of the center shaft 1, and the hollow shaft is connected to the outside of the bearings. The center shaft and the hollow shaft are driven by two V-belts with different drive ratios, to achieve different speeds of the shafts in the same direction. The rotation centers are on the same straight line, thus achieving different speeds of the rotating evacuation cone and the limit feeding rod in the same direction, that is, the directions are the same but the speeds are different.

Potatoes are conveyed at equal intervals by the limit feeding rod.

Equal interval conveying: the hollow shaft I-05 has a constant rotation speed and moves uniformly, the distance between two feeding rods can only accommodate one potato, and the potato will reach the leak hole after the feeding rods move a certain distance, so as to achieve equal interval. The speed of the limit feeding rod is controlled to adjust the falling time of potatoes.

Since the speed of the rotating evacuation cone is greater than that of the limit feeding rod, potatoes have sufficient time to reach the desired positions, and the potatoes that have reached the desired state between the two feeding rods are ensured.

The bearing pot has an empty circle in the center, the U-shaped slide way I-11 is formed between its outer circle and inner circle, and the height of the bearing pot is nearly three times the short axis of the potato.

Working principle of the device: the rotating evacuation cone provides friction to the potato, because the force on the potato is at either end of the long axis of the potato.

According to the translation theorem of force, the force acting on a rigid body can be moved equivalently in parallel from the original point of action to any point in the rigid body, and a force couple is added at the same time, wherein the force couple is the torque of the original force on the new point. Then, the friction f1 can be translated to the center of gravity of the potato to obtain a force having the same magnitude as f1 and a force couple M=1×f1, which causes the potato to rotate. I is the distance from the point of friction to the center of gravity of the potato.

When the long axes of potatoes are arranged in a neat arc on the u-shaped slide way, it is in a desired state at this time, and the limit feeding rod moves at a uniform speed and conveys the potatoes to the leak hole at equal intervals.

In the process of specific use, potatoes are randomly distributed in the device at first, which includes the following three situations.

1. A potato is already at a desired position in the U-shaped slide way I-11 of the bearing pot, and its long axis corresponds to the U-shaped slide way I-11 and is perpendicular to the rotating evacuation cone.
2. A part of a potato is in the U-shaped slide way I-11 of the bearing pot, and the other part is in contact with the rotating evacuation cone.
3. A whole potato is on the rotating evacuation cone.

The motor operates, the center shaft drives the rotating evacuation cone to rotate, and the limit feeding rod rotates slowly at a speed that is smaller than the speed of the rotating evacuation cone. The bearing pot, the evacuation blades, the shield, and the leak hole are all immobile.

Movement Example 1 (Corresponding to the First Situation)

The rotating evacuation cone generates thrust F and friction $f_1$ due to contact with the potato. In the vertical direction, $G=F_n$. In the horizontal direction, 1. If the thrust F is larger than the friction $f_1$, the friction $f_1$ is static friction, and the potato moves forward under the action of the thrust F; and if F is smaller than $f_2$, F is not enough to push the potato. The potato is in a desired state in the U-shaped slide way I-11. If the potato cannot move forward at this time, the potato will eventually be pushed to the leak hole by the force $F_2$ of the limit feeding rod.
2. If the potato advances under the action of thrust F and moves to next limit feeding rod in advance, the potato will still be blocked by the limit feeding rod, and will reach the exit with the movement of the limit feeding rod.

Therefore, regardless of the magnitudes of F and $f_1$, the potato will arrive at the exit within the specified time.

Where F=T/L, T—turntable torque, L—turntable radius R.

Where the friction between the potato and the U-shaped slide way I-11 is $f_1=u_1$ mg.

Movement Example 2 (Corresponding to the Second Situation)

A force F is provided on the surface of the rotating evacuation cone in the direction perpendicular to the bus of the rotating evacuation cone. The force F is decomposed into a force F' perpendicular to the long axis and a force F" parallel to the long axis. Since F" is not enough to change the state of the potato in the direction of long axis, it can be ignored.

1. If the long axis of the potato is not in the same direction as the bus, when the previous potato moves forward, a certain space is left from the current potato. Since the inclination angle of the potato relative to the horizontal plane is not 90°, the potato falls from one end to the U-shaped slide way I-11 under the component force of its gravity and F' to reach the desired state, so $F>f_1$ is required in this case to leave a gap for turning the potato.
2. If the potatoes are close to each other or the long axis of a potato is on the same straight line as the rotating evacuation cone bus, $f_2$ generates a torque on the center of gravity of the potato, so that the potato rotates about the center, and the long axis is perpendicular to the radius of the rotating evacuation cone, reaching the desired state.

In both cases, the potato is eventually slowly conveyed to the leak hole under the action of the limit feeding rod. The potato slowly conveyed moves a certain distance, and falls under the action of gravity G in a state that the long axis and gravity of the potato are on the same line.

To achieve the turning the potato, there cannot be static friction between the potato and the rotating evacuation cone. If it is static friction, there is no force in the direction perpendicular to the long axis of the potato on the rotating evacuation cone, the static friction and F' are balanced, $F=f_2$, the rotation of the rotating evacuation cone is blocked, and the potato cannot be turned. Therefore, $F>f_2$, wherein the friction between the potato and the rotating evacuation cone is $f_2=\mu_2 F_{N2}$.

$$G=F_{N1}+F_{N2}\sin\theta$$

G is the gravity of the potato, G=mg.

$F_{N2}$ is a support force for the potato on the rotating evacuation cone, in units of N.

θ is an angle between the turntable bus and the center shaft.

$F_{N1}$ is a support force for the potato on the U-shaped slide way I-11.

$$F_{N2}\cos\theta=F_{N2}.$$

$F_{N2}$ is a support force of the inner wall of the bearing pot for the potato.

The torque of the rotating evacuation cone on the potato is $M=L_1\times f_2\cos\alpha$, in units of N·m.

α is an angle between the long axis of the potato and the bus of the rotating evacuation cone.

$L_1$ is the distance from the friction point to the center of the potato, i.e. is half of the long axis of the potato.

Movement Example 3 (Corresponding to the Third Situation)

The whole potato is on the rotating evacuation cone, and the following also describes that the potato is blocked below from falling into the U-shaped slide way I-11 of the bearing pot in the first two situations. Equivalently, the potato moves circumferentially on the rotating evacuation cone, which is different from the first two situations. Because the potato in the U-shaped slide way I-11 has an upward force along the bus of the rotating evacuation cone and a downward component force of the potato itself, the potato does not move along the bus of the rotating evacuation cone.

If the force F provided by the rotating evacuation cone is greater than the friction $f_3$ of the potato on the turntable, the potato and the rotating evacuation cone slide relatively, and the potato hardly moves. If F is smaller than f, the potato moves together with the rotating evacuation cone due to the static friction, the potato turns to touch the evacuation blades, and is blocked by the evacuation blades from advancing because the evacuation blades are immobile. The potato below arrives at the desired position in both cases, and is pushed to the leak hole by the limit feeding rod to arrive at next device. At this time, the potato on the rotating evacuation cone falls into the bearing pot, which becomes one of the situations in movement example 1 and movement example 2. The potato finally arrives at the leak hole at the exit under the action of the limit feeding rod.

Measurement of Dynamic Friction Factor $\mu_2$

The dynamic friction factor is measured using Newton's theorem. The potato slides down at an acceleration a along a slope of the same material as the rotating evacuation cone, the oblique angle is $\alpha$, the dynamic friction factor is $u_2$, and force analysis is performed on the potato to obtain:

$$\mu_2 = \tan\alpha - \frac{\alpha}{g\tan\alpha}$$

The acceleration is measured by using photoelectric gates. Two photoelectric gates are mounted on the slope. It is assumed that the time when passing the first photoelectric gate is $t_1$, the speed of a slide block is $v_1$, the time when passing the second photoelectric gate is $t_2$, the speed is $v_2$, the time interval that a left light barrier for the slide block passes the two photoelectric gates is $t_3$, the center speed of the light barrier is the speed of the potato, and $t_3$ is corrected to $t_4$, then, $$\mu_2 = \tan\alpha - \frac{s(t_1 - t_2)}{t_1 t_2 t_4 g\cos\alpha}$$

$$v_1 = \frac{s}{t_1},\ v_2 = \frac{s}{t_2},\ t_4 = t_3 - \frac{t_1}{2} - \frac{t_2}{2}$$

$$a = \frac{v_2 - v_1}{t_4}$$

The time $t_1$, $t_2$, and $t_3$ $t_1$, $t_2$, $t_3$ are automatically collected by the photoelectric gates, in units of m/s, the angle is read, and then the dynamic friction factor $\mu_2$ can be calculated.

The dynamic friction factor $\mu_1$ between the potato and the U-shaped slide way I-11 can be solved by the same method.

Design of Rotating Evacuation Cone

As described in Movement Example 1, F is not required specifically.

As described in Movement Example 2, $F>f_2$, and in order to achieve better effects, $F>f_1$ is preferred. $f_1$ and $f_2$ $f_1$ 和 $af_2$ are shown in Movement Example 1 and Movement Example 2, respectively.

As described in Movement Example 3, F is not required specially.

$$F = \frac{T}{L}$$

L is the radius of the rotating evacuation cone and is in units 6 mm, F is in units of N, T is in units of N·mm, and the power P of the center shaft 1 is in units of KW.

In order to achieve the purposes that a round of potatoes have reached the desired state when the device rotates about five rounds, and a potato falls within 10 s, the center shaft rotates five rounds within 10 s, $n_1$ (the rotation speed of the center shaft I-14) is set.

$$T = 9550000\frac{P}{n_1}$$

Design of Belt Drive Connected to the Center Shaft 1

The parameters of the center shaft 1 are obtained, and the diameter of the center shaft is $d_1$ (mm). It is stated here that $n_1$ is the rotation speed of the large pulley, which is equal to the rotation speed of the center shaft 1, and $n_2$ is the rotation speed of the small pulley.

The rotation efficiency of the V-belt is 0.94 to 0.97, $\varphi_1$=0.95, the efficiency of the coupling is $\varphi_2$=0.99, $\phi=\varphi_1\varphi_2\Phi=\varphi_1\varphi_2$, and the power of the motor is:

$$P_d = \frac{P}{\varphi}$$

If the drive ratio of the V-belt is $i_1$=2~4, the speed of the motor is:

$$n_2 = i_1 \times n_1 \text{ (r/min)}$$

The motor is selected with a full load speed $n_w$, the drive ratio of the V-belt is $i_1$=2, and the working coefficient looked up is $K_A$=1.0, so:

$$P_{ca} = K_A \times P_d$$

The belt type is selected according to $P_{ca}$ and $n_w P_{ca}$, $n_w$.

The datum diameter of the primary small pulley is $d_{d_1}$=50 mm, and the belt speed is checked by:

$$v_1 = \frac{\pi d_{d_1} n_w}{60 \times 1000}$$

5 m/s<$v_1$<30 m/s, so the belt speed is appropriate.

The datum diameter of the large pulley is $d_{d_2}=d_{d_1}\times i$, and the standard value $d_{d_2}$ is selected according to the manual. $d_{d_2}$ The center distance $\alpha_0$ is initially determined according to $0.67(d_{d_1}+d_{d_2})\le a_0\le 2(d_{d_1}+d_{d_L})$, and the datum length is calculated:

$$L_{d_0} = 2\alpha_0 + \frac{\pi}{2}(d_{d_1} + d_{d_2}) + \frac{(d_{d_2} - d_{d_1})^2}{4\alpha_0}$$

The datum length $L_d$ is selected according to the manual, and the actual center distance is:

$$a \approx \alpha_0 + \frac{L_d - L_{d_o}}{2}$$

The wrap angle on the small pulley is verified by:

$$\alpha_1 \approx 180 - (d_{d_2} - d_{d_1})\frac{57.3^r}{\alpha} > 120^r$$

$P_0$ is obtained by looking up the manual according to $d_{d_1}$ and $n_2$, $\Delta P_0$ is obtained by looking up the manual according to $n_2$, i and the belt type, $K_\alpha$ and $K_L$, are obtained by looking up the manual. The rated power of V-belts is:

$$P_r=(P_0+\Delta P_0)\cdot K_\alpha\cdot K_L$$

The number of V-belts is:

$$Z=\frac{P_{ca}}{P_r}$$

The initial tensile stress of V-belts is:

$$F_0=500\frac{(2.5-K_\alpha)\ P_{ca}}{K_\alpha Zv}$$

The pressure on the shaft is $$F_p=2ZF_0\ \sin\frac{\alpha_1}{2}.$$

Belt Drive Connected to the Hollow Shaft 2

Similar to the center shaft 1 except that the speed is $n_g$=6 r/min equal to the speed of the hollow shaft 2. After the motor is selected, the drive ratio is changed to change the speed, wherein the drive ratio is $i_2$=4. Similarly, the small pulley is $d_{d_1}$, the large pulley is $d_{d_2}'=d_{d_1}\times i_2$, the datum length is $L_d'$, the actual center a' distance is a', the wrap angle of the $\alpha_1'$, small pulley is $\alpha_1'$, the rated power of V-belts is $P_r'$, the number of V-belts is Z', and the initial tensile stress of V-belts is $F_0'$.

Selection of Bearings

Since the bearings only play a role in connection, simple deep groove ball bearings are used.

The thin shaft diameter at two $d_1$ ends is $d_1$, the bearing is positioned, and $d_2$=22 mm. The distance between two bearings is $l_1$, and the distance between the bearing and the pulley is $l_2$.

$$F_{a_1}=F_P\times(l_1+l_2)$$

$$F_{a_2}=F_P\times l_2$$

$$F_{a_1}=F_{a_2}+F_{a_1}.$$

Then, the equivalent dynamic load of the bearing is:

$$P=f_d\times F_{a_1}$$

$f_d$—Load factor, here it is 1.0.

The life expectancy of the bearing is 3 years, working for 8 hours, $$L_h'=3\times8\times300=7200h.$$

The basic rated dynamic load is:

$$C'=P\sqrt[3]{\frac{60nL_h'}{10^6}}$$

ε—Exponent, ε=3 for the deep groove ball bearings.

The rated dynamic load is calculated, the closest value greater than C' is looked up from the manual, the model of bearings is selected, and the rated dynamic load is obtained.

The actual life is calculated according to:

$$L_h=\frac{10^6}{60n}\left(\frac{C}{P}\right)^3$$

And the life here certainly meets the requirements.

It could be appreciated that in this Description, the reference terms "an embodiment", "another embodiments", "other embodiments", or "the first embodiment to the N embodiment", etc. mean that specific features, structures, materials or characteristics described in conjunction with the embodiments or examples are included in at least one embodiment or example of the present invention. In this Description, the schematic descriptions of the above terms do not necessarily refer to the same embodiment or example. Moreover, the specific features, structures, materials or characteristics described may be combined appropriately in one or more embodiments or examples.

Described above are merely preferred embodiments of the present disclosure, and the present disclosure is not limited thereto. Various modifications and variations may be made to the present disclosure for those skilled in the art. Any modification, equivalent substitution, improvement or the like made within the spirit and principle of the present disclosure shall fall into the protection scope of the present disclosure.

The invention claimed is:

1. A conical self-positioning limit feeding device, comprising:

a bearing pot, an empty circle being reserved in the center of the bearing pot, a U-shaped slide way being formed between an outer circle and an inner circle, a rotating evacuation cone and a limit feeding rod being arranged in the bearing pot and configured to rotate in the same direction, a rotating speed of the rotating evacuation cone being greater than that of the limit feeding rod;

wherein the bearing pot is configured to receive materials, the rotating evacuation cone is configured to rotate the materials in the U-shaped slide way of the bearing pot to make long axes of the materials tangent to a radius of the rotating evacuation cone under a torque generated by friction between the rotating evacuation cone and the materials;

and the limit feeding rod is configured to rotate and push the materials to an exit at equal intervals, thereby achieving an arrangement of the materials in a direction of the long axes.

2. The conical self-positioning limit feeding device according to claim 1, wherein the limit feeding rod crosses the U-shaped slide way outside the inner circle of the bearing pot.

3. The conical self-positioning limit feeding device according to claim 1, wherein the rotating evacuation cone is a cone and is configured to rotate with a center shaft, a bearing outer bearing seat at a top end of the center shaft is connected to evacuation blades, and the evacuation blades are attached to an outer surface of the rotating evacuation cone.

4. The conical self-positioning limit feeding device according to claim 3, wherein the limit feeding rod is connected to a hollow shaft by a bracket, and the limit feeding rod is configured to rotate with the hollow shaft, and is on the same straight line as a radius of the bearing pot.

5. The conical self-positioning limit feeding device according to claim 4, wherein rotation centers of the limit feeding rod and the rotating evacuation cone are the same, a pair of bearings are connected to an outside of the center shaft, the hollow shaft is connected to an outside of the bearings, and the center shaft and the hollow shaft are driven by two V-belts with different drive ratios, to achieve different speeds of the shafts in the same direction.

6. The conical self-positioning limit feeding device according to claim 1, wherein the empty circle is in the middle of the bearing pot, and has a size matching a size of a bottom surface of the rotating evacuation cone, which facilitates an engagement with the rotating evacuation cone.

7. The conical self-positioning limit feeding device according to claim 6, wherein the U-shaped slide way is composed of two concentric circles and is outside the empty circle, and a width of the U-shaped slide way approximates a length of a short axis of the materials, which facilitates a positioning of the materials in a short-axis direction.

8. The conical self-positioning limit feeding device according to claim 7, wherein a leak hole is formed at the U-shaped slide way, the materials arrive at a next device through the leak hole, and the leak hole has a size of a largest one of the materials.

9. The conical self-positioning limit feeding device according to claim 1, wherein a shield is arranged above the leak hole; and wherein the shield prevents the materials from rolling over, and at the same time blocks the materials on another side that have not reached a desired state and have just been poured into the device above the leak hole from entering a next device accidentally.

10. A control method of the conical self-positioning limit feeding device according to claim 1, the method comprising:

placing materials in the bearing pot, and controlling the rotating evacuation cone and the limit feeding rod to rotate in the same direction, the rotating speed of the rotating evacuation cone being greater than that of the limit feeding rod;

rotating the rotating evacuation cone, so that the materials rotate in the U-shaped slide way of the bearing pot by the torque generated by the friction between the rotating evacuation cone and the materials, till the long axes of the materials are tangent to the radius of the rotating evacuation cone; and rotating the limit feeding rod to push the materials to the exit at equal intervals, thereby achieving the arrangement of the materials in the direction of the long axes.

* * * * *